United States Patent [19]

Singhal et al.

[11] 4,454,024

[45] Jun. 12, 1984

[54] HYDROCONVERSION PROCESS

[75] Inventors: Gopal H. Singhal, Houston, Tex.; Gordon F. Stuntz, Baton Rouge, La.

[73] Assignee: Exxon Research and Engineering Co., Florham Park, N.J.

[21] Appl. No.: 438,407

[22] Filed: Nov. 1, 1982

[51] Int. Cl.[3] ..... C10G 45/30; C10G 47/34

[52] U.S. Cl. ..... 208/111; 208/56; 208/214; 208/251 H; 208/254 H

[58] Field of Search ..... 208/111, 56, 120, 214

[56] References Cited

U.S. PATENT DOCUMENTS

| | | | |
|---|---|---|---|
| 3,147,206 | 9/1964 | Tulleners | 208/56 |
| 3,413,212 | 11/1968 | Weisz | 208/120 |
| 3,617,481 | 11/1971 | Voorhies, Jr. et al. | 208/50 |
| 4,002,557 | 1/1977 | Hartley et al. | 208/120 |
| 4,200,520 | 4/1980 | Gladrow et al. | 208/120 |
| 4,280,895 | 7/1981 | Stuntz et al. | 208/113 |
| 4,330,392 | 5/1982 | Bearden, Jr. et al. | 208/10 |
| 4,363,716 | 12/1982 | Greene et al. | 208/80 |
| 4,372,840 | 2/1983 | Bearden et al. | 208/113 |
| 4,372,841 | 2/1983 | Stuntz | 208/113 |

*Primary Examiner*—Delbert E. Gantz
*Assistant Examiner*—O. Chaudhuri
*Attorney, Agent, or Firm*—Marthe L. Gibbons

[57] ABSTRACT

A slurry hydroconversion process is provided wherein a heavy hydrocarbonaceous oil, in which is dispersed a metal-contaminated, partially deactivated zeolitic cracking catalyst, is converted to lower boiling products in the presence of a molecular hydrogen-containing gas, and a hydrogen donor diluent.

9 Claims, 1 Drawing Figure

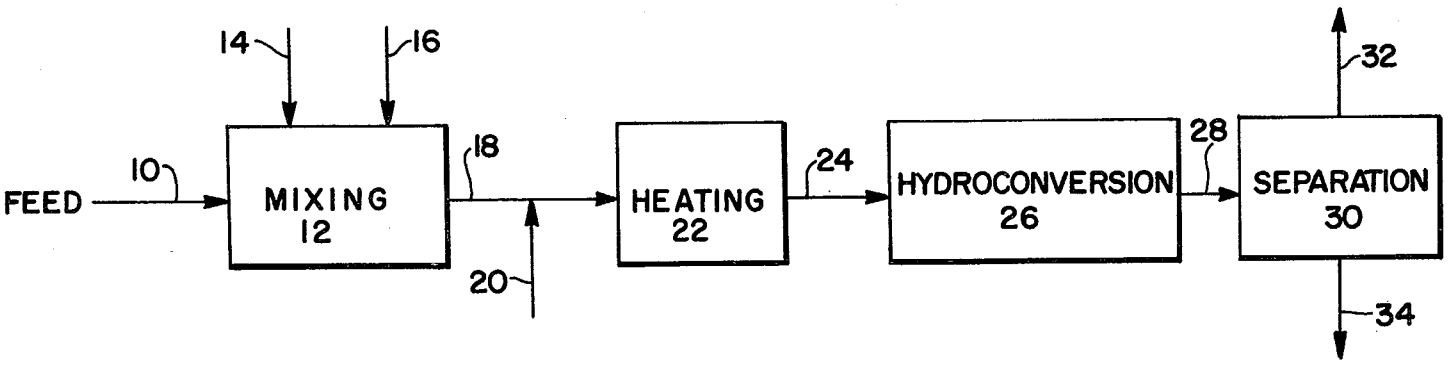
FEED
10
MIXING
12
14
16
18
20
HEATING
22
24
HYDROCONVERSION
26
28
SEPARATION
30
32
34

HYDROCONVERSION PROCESS

BACKGROUND OF THE INVENTION

1. Field of the Invention

The present invention relates to an improvement in a process for the conversion of hydrocarbonaceous oils in the presence of hydrogen and a catalyst.

2. Description of the Prior Art

Hydroconversion processes conducted in the presence of hydrogen and a hydroconversion catalyst are known.

The term "hydroconversion" is used herein to designate a process conducted in the presence of hydrogen in which at least a portion of the heavy constituents of the feed is converted to lower boiling constituents. The concentration of nitrogenous contaminants, sulfur contaminants and metallic contaminants of the feeds may also be simultaneously decreased.

U.S. Pat. No. 4,330,392 discloses a slurry hydroconversion process in which a solid vanadium-containing catalyst and a hydrogen halide are used to convert heavy hydrocarbonaceous oils to lower boiling products.

U.S. Pat. No. 3,617,481 discloses a combination coking and coke gasification process in which the metal-containing coke gasification residue is used as catalyst in the hydrotreating stage.

U.S. Pat. No. 4,002,557 discloses a process for cracking residual hydrocarbonaceous oils in which the oil is mixed with a hydrogen donor and cracked in the presence of a zeolitic cracking catalyst.

It has now been found that a slurry hydroconversion process utilizing a hydrogen donor diluent, molecular hydrogen and a metal-contaminated, at least partially deactivated zeolitic cracking catalyst will provide advantages that will become apparent in the ensuing description.

SUMMARY OF THE INVENTION

In accordance with the invention there is provided, a hydroconversion process which comprises: (a) contacting a mixture comprising a hydrocarbonaceous feed, a hydrogen donor diluent and a catalyst with a molecular hydrogen-containing gas at hydroconversion conditions, said catalyst comprising a metal contaminated, at least partially deactivated zeolitic cracking catalyst comprising a metal contaminant selected from the group consisting of vanadium, nickel, iron, copper, and mixtures thereof, and (b) recovering a hydroconverted oil product.

BRIEF DESCRIPTION OF THE DRAWING

The FIGURE is a schematic flow plan of one embodiment of the invention.

DESCRIPTION OF THE PREFERRED EMBODIMENT

The process of the invention is generally applicable for the hydroconversion of hydrocarbonaceous oils, such as heavy hydrocarbonaceous oils having constituents boiling above 1050° F.

All boiling points referred to herein are atmospheric pressure boiling points unless otherwise specified. Suitable hydrocarbonaceous oils include heavy mineral oils; whole or topped petroleum crude oils, including heavy crude oils; asphaltenes, residual oils having initial boiling points ranging from about 650° F. to about 1050° F., such as atmospheric residua boiling above 650° F. and vacuum residua boiling above 1050° F.; tar; bitumen; tarsand oil; shale oil; hydrocarbonaceous oils derived from coal liquefaction processes, including coal liquefaction bottoms, and mixtures thereof. The Conradson carbon residue of such oils will generally be at least 2, preferably at least 5 weight percent and may generally range up to 50 weight percent. As to Conradson carbon residue, see ASTM Test D-189-65. The process is particularly well suited to hydroconvert heavy crude oils and residual oils which generally contain a high content of metallic contaminants (nickel, iron, vanadium) usually present in the form of organometallic compounds and a high content of sulfur and nitrogen compounds and a high Conradson carbon residue. Preferably the feed is a heavy hydrocarbonaceous oil having at least 10 weight percent materials boiling above 1050° F., more preferably having at least 25 weight percent materials boiling above 1050° F.

Referring to the figure, a hydrocarbonaceous oil feed is introduced by line 10 into mixing zone 12. A metal contaminated, at least partially deactivated zeolitic cracking catalyst comprising at least one metal contaminant selected from the group consisting of vanadium, nickel, iron, copper and mixtures thereof is introduced into mixing zone 12 by line 14 to disperse the catalyst (solid particles) in the oil feed. Suitable metal contaminated zeolitic cracking catalysts are any of the zeolitic catalysts that are used for catalytic cracking and which typically comprise crystalline metallosilicates such as a crystalline aluminosilicate zeolite, for example, the zeolite designated as zeolite Y, ultrastable Y zeolite, ZSM-type zeolites and a matrix which may be a clay matrix or an inorganic oxide matrix such as alumina, silica, silica-alumina, boria, magnesia, zirconia, strontia, titania and mixtures thereof. The metal-contaminated catalysts may comprise from about 0.2 to about 20 weight percent of the metal contaminants. A sufficient amount of metal contaminated catalyst is added to the oil feed to provide at least 0.004 weight percent of said metal contaminants, calculated as elemental metals, preferably from about 0.02 to about 10 weight percent of said metal contaminant, calculated as elemental metal, based on the weight of said oil feed. The particle size of the catalyst may range from about 0.5 to 200 microns, preferably from about 10 to about 100 microns in diameter. Desirably, the weight of total catalyst in the oil feed may range from about 0.2 to 50 weight percent catalyst, based on the oil feed. A hydrogen donor diluent is introduced into mixing zone 12 by line 16 such as to provide a hydrogen donor diluent to hydrocarbonaceous oil weight ratio ranging from about 0.4:1 to 2.5:1, preferably from about 1:1 to 1.5:1. The term "hydrogen donor diluent" is used herein to designate a fluid which comprises at least 25 weight percent, preferably at least 50 weight percent of compounds which are known to be hydrogen donors under the temperature and pressure conditions in the hydroconversion zone. Although the hydrogen donor diluent may be comprised solely of one or a mixture of hydrogen donor compounds, the hydrogen donor diluent employed will normally be a product stream boiling between 350° F. and about 1050° F., preferably between about 400° F. and 700° F. derived from the hydroconversion process. The given fraction may be subjected to hydrogenation to hydrogenate the aromatics present in the fraction to hydroaromatics. If desired, hydrogen donor compounds and/or hydrogen donor compound precursors may be added to the given fraction. Compounds known to be hydrogen donor compounds or precursors thereof include indane, $C_{10}$ to $C_{12}$ tetralins, decalins, methylnaphthalene, dimethylnaphthalene, $C_{12}$ and $C_{13}$ acenaphthenes, tetrahydroacenaphthene and quinoline. Suitable hydrogen donor diluents include hydrogenated creosote oil, hydrogenated intermediate product streams from catalytic cracking of hydrocarbon oil and coal derived liquids which are rich in hydrogen donor compounds or hydrogen donor compound precursors.

The mixture of oil feed-catalyst and hydrogen donor diluent is removed from mixing zone 12 by line 18. The molecular hydrogen-containing gas is introduced into the mixture carried in line 18 by line 20. If desired, the hydrogen-containing gas may also comprise a sulfiding agent such as hydrogen sulfide or a hydrogen sulfide precursor, for example, carbonyl sulfide or carbon disulfide. Alternatively and optionally, the sulfiding agent may be introduced directly into mixing zone 12 or directly into hydroconversion 26. The hydrogen-containing gas may be preheated prior to being introduced into line 18 to provide a portion of the heat. The resulting mixture is then passed to heating zone 22 where the mixture is preheated. The preheated mixture is removed from heating zone 22 by line 24 and passed to hydroconversion zone 26 which is maintained at a temperature ranging from about 600 to about 900° F., preferably at a temperature ranging from about 800° to about 880° F. and a hydrogen partial pressure ranging from about 500 to about 5000 psig, preferably from about 1000 to about 3000 psig.

The contact time may vary widely depending on the desired level of conversion. Suitable contact time may range broadly from about 0.1 to 10 hours, preferably from about 0.15 to 8 hours.

The mixed phase product effluent of hydroconversion zone 26 is removed by line 28 and passed to separation zone 30 where it is separated by conventional means into a predominantly vaporous phase comprising light normally gaseous hydrocarbons and hydrogen removed by line 32 and a principally liquid phase removed by line 34. The vaporous phase may be separated by conventional means to obtain a hydrogen-rich gas, which, if desired, may be recycled to the process. The normally liquid hydrocarbon phase, i.e. hydroconverted oil product, may be separated into fractions, as is well known in the art. If desired, at least a portion of any of these fractions may be recycled to the hydroconversion process. As previously stated, one of these fractions may be used as the hydrogen-donor diluent if it comprises enough hydrogen donor compounds or, if it comprises aromatics, the separated fraction may be hydrogenated to convert the aromatics to partially hydrogenated aromatics prior to recycling the fraction of hydrogen donor diluent. The following examples are provided to illustrate the invention.

EXAMPLE 1

A metal-contaminated, partially deactivated (i.e. spent) cracking catalyst, herein designated catalyst A, was used in the following experiments. Catalyst A had the composition shown in Table I.

TABLE I

| CATALYST A | |
|---|---|
| V, % based on total catalyst | 0.61 |
| Fe, % based on total catalyst | 0.61 |
| Ni, % based on total catalyst | 0.48 |
| Zeolite type | Y |
| Zeolite, wt. % | about 20 |
| Rare earth metals calculated as rare earth oxides, based on total catalyst | 3.5 |
| Amorphous silica-alumina, wt. % | about 50 |

An Arabian heavy hydrocarbonaceous oil having 90% materials boiling above 1000° F.+ was placed in a 300 ml autoclave with magna drive, together with 10 weight percent on oil of catalyst A and tetralin as the hydrogen donor solvent. The diluent to hydrocarbonaceous oil ratio was 1 to 1; 0.5 g of carbon disulfide was included to keep the metals in a sulfided state. Molecular hydrogen gas was then introduced into the autoclave to provide an initial pressure of 1000 psig at room temperature for run 1 and 780 psig for run 2. Stirring was begun at 200° F. and the contents were heated further to run temperature, namely, 840° F. Molecular hydrogen was then added to bring the pressure to the desired level and the run continued for 60 minutes. The results are summarized in Table II. Conversion was calculated from the following equation:

$$\text{Conversion} = \frac{(\text{wt. } 1000^\circ\text{ F.} + \text{feed charged} - \text{wt. } 1000^\circ\text{ F.} + \text{product}) \times 100}{\text{wt. } 1000^\circ\text{ F.} + \text{feed charged}}$$

Runs 1 and 2 were runs in accordance with the present invention utilizing a partially deactivated metal-contaminated catalyst.

TABLE II

| Run No. | 1 | 2 |
|---|---|---|
| $C_1$—$C_3$, wt. % on feed | 5.5 | 5.7 |
| $C_4$-1000° F., wt. % on 1000° F.+feed | 73.4 | 71.2 |
| 1000° F.+, wt. % on feed | 19.95 | 22.3 |
| Conversion | 80.1 | 77.7 |

EXAMPLE 2

Comparative runs were made without any catalyst, with catalyst A (metals-contaminated catalyst described in Table I) and with a non-contaminated by metals catalyst, herein designated catalyst B, which was the catalyst from which metal-contaminated catalyst A was obtained. In some runs, the amount of catalyst A was varied. In other runs, the hydrogen donor diluent to Arabian heavy oil was varied, while in other runs the pressure and the time were varied. The feed used for this set of experiments was the same Arabian heavy oil feed described in Example 1. The temperature of the reaction for all of the runs was 840° F. In the runs utilizing catalyst A, 0.5 g of carbon disulfide was included in the oil feed to keep the metals in a sulfided state. The results are summarized in Table III.

TABLE III

CONVERSION OF ARABIAN HEAVY OIL UNDER DIFFERENT CONDITIONS

| | | | | CONDITIONS | | WT. % PRODUCTS | | |
|---|---|---|---|---|---|---|---|---|
| Run No. | Catalyst | Amount[a] | S/R[b] | Pressure PSIG | Time Min. | $C_4$-1000° F. | $C_1$—$C_3$ | Conversion |
| (1) | A | 10% | 1 | 2300 | 60 | 73.4 | 5.5 | 80.1 |
| (3) | None | — | 1 | 2300 | 60 | 65.3 | 4.2 | 72.8 |
| (4) | B | 5% | 1 | 2300 | 60 | 67.6 | 10.8 | 80.9 |
| (5) | A | 5% | 1 | 2300 | 60 | 72.6 | 4.3 | 78.1 |
| (6) | A | 5% | 1.6 | 2500 | 30 | 76.6 | 4.6 | 81.4 |
| (7) | A | 2.5% | 1 | 2300 | 240 | 75.3 | 10.4 | 85.5 |

[a]Wt. % catalyst added.
[b]S/R denotes the ratio of hydrogen donor diluent (tetralin) to Arabian heavy oil.

Runs 1, 5, 6 and 7 were runs in accordance with the present invention utilizing a metal-contaminated partially deactivated cracking catalyst. As can be seen from Table III, the presence of 10 weight percent catalyst A gave higher liquid yields and conversion than a comparable run (run 3) without catalyst. Comparing runs 3, 4 and 5, it can be seen that catalyst B, the uncontaminated cracking catalyst, gave a slightly higher liquid yield than run 3 without catalyst; however, the amount of gaseous products increased significantly while catalyst A, which was the metal contaminated catalyst in accordance with the present invention, increased the liquid yield without significantly increasing the amount of gas production. Additional increases in liquid yield can be obtained by increasing the pressure and diluent to oil feed ratio while reducing the run time (see run 6). High liquid yields and conversion can also be obtained by increasing the residence time (run 7) even though the catalyst concentration was decreased to 2.5%.

What is claimed is:

1. A slurry hydroconversion process which comprises:

(a) contacting a mixture comprising a hydrocarbonaceous feed having constituents boiling above 1050° F., a hydrogen-donor diluent and a catalyst with a molecular hydrogen-containing gas at hydroconversion conditions, including a hydrogen partial pressure ranging from 500 to 5000 psig, said catalyst comprising a metal contaminated, at least partially deactivated zeolitic cracking catalyst comprising a metal contaminant selected from the group consisting of vanadium, nickel, iron, copper and mixtures thereof, said catalyst comprising said metal contaminant in an amount ranging from about 0.2 to about 20 weight percent, based on said catalyst, and (b) recovering a hydroconverted oil product.

2. The process of claim 1 wherein said metal-contaminated catalyst is present in said mixture in an amount sufficient to provide at least 0.004 weight percent of said metal contaminant, calculated as elemental metal, based on said hydrocarbonaceous feed.

3. The process of claim 1 wherein said metal-contaminated catalyst is present in said mixture in an amount sufficient to provide from about 0.02 to about 10 weight percent of said metal contaminant, calculated as elemental metal, based on said hydrocarbonaceous feed.

4. The process of claim 1 wherein said metal-contaminated catalyst comprises a crystalline alumino-silicate zeolite and an inorganic oxide matrix.

5. The process of claim 4 wherein said inorganic oxide matrix is selected from the group consisting of alumina, silica, silica-alumina, magnesia, zirconia, boria, titania and mixtures thereof.

6. The process of claim 1 wherein said diluent and said hydrocarbonaceous feed are present in a weight ratio ranging from about 0.4:1 to 2.5:1.

7. The process of claim 1 wherein said hydroconversion conditions include a temperature ranging from about 600° to 900° F.

8. The process of claim 1 wherein said hydrogen donor diluent comprises at least about 25 weight percent hydrogen donor compounds or precursors thereof.

9. The process of claim 1 wherein said mixture additionally comprises a sulfiding agent selected from the group consisting of hydrogen sulfide, hydrogen sulfide precursors and mixtures thereof.

* * * * *